US007264023B2

(12) United States Patent
Jackson

(10) Patent No.: US 7,264,023 B2
(45) Date of Patent: Sep. 4, 2007

(54) WEAVED ARTICLE OR GARMENT AND METHOD OF MAKING WEAVED ARTICLE OR GARMENT

(76) Inventor: Rene'e P. Jackson, 75 Wheeler Ave., # 202, Bridgeport, CT (US) 06606

( * ) Notice: Subject to any disclaimer, the term of this patent is extended or adjusted under 35 U.S.C. 154(b) by 0 days.

(21) Appl. No.: 11/244,199

(22) Filed: Oct. 6, 2005

(65) Prior Publication Data

US 2006/0231153 A1 Oct. 19, 2006

Related U.S. Application Data

(60) Provisional application No. 60/616,124, filed on Oct. 6, 2004.

(51) Int. Cl.

| | |
|---|---|
| ***D03D 15/00*** | (2006.01) |
| ***D03D 31/00*** | (2006.01) |
| *D03D 25/00* | (2006.01) |
| *D03D 41/00* | (2006.01) |

(52) U.S. Cl. ..... 139/420 R; 139/383 R; 139/420 A; 139/426 R; 442/186

(58) Field of Classification Search ..... 139/383 R, 139/420 R, 424, 426 R, 420 A; 442/185, 442/186

See application file for complete search history.

(56) References Cited

U.S. PATENT DOCUMENTS

| | | | | | |
|---|---|---|---|---|---|
| 2,260,052 | A | * | 10/1941 | Passavant | 428/102 |
| 2,557,819 | A | * | 6/1951 | Fischer et al. | 139/385 |
| 2,804,098 | A | * | 8/1957 | Walters | 139/420 R |
| 2,958,923 | A | * | 11/1960 | Fischer et al. | 112/400 |
| 3,927,164 | A | * | 12/1975 | Shimabukuro | 264/558 |
| 4,097,631 | A | * | 6/1978 | Wilken | 428/114 |
| 4,252,871 | A | * | 2/1981 | Sundberg | 429/140 |
| 4,313,245 | A | * | 2/1982 | Yamaguchi | 139/384 B |
| 4,980,227 | A | * | 12/1990 | Sekiguchi et al. | 442/3 |
| 5,139,859 | A | * | 8/1992 | Karvanen | 442/185 |
| 5,164,250 | A | * | 11/1992 | Paz Rodriguez | 442/186 |
| 5,395,665 | A | * | 3/1995 | Planeta | 428/36.1 |
| 5,564,476 | A | * | 10/1996 | Golz | 139/388 |
| 5,972,139 | A | * | 10/1999 | Chu | 156/84 |
| 6,162,244 | A | * | 12/2000 | Braun et al. | 623/1.12 |
| 6,302,584 | B1 | * | 10/2001 | Derby et al. | 383/67 |
| 6,367,513 | B1 | * | 4/2002 | Cain | 139/383 R |
| 6,539,983 | B2 | * | 4/2003 | Khokar | 139/383 A |
| 6,559,077 | B1 | * | 5/2003 | Moore | 442/2 |
| 6,817,384 | B2 | * | 11/2004 | Chang | 139/424 |
| 6,954,944 | B2 | * | 10/2005 | Feher | 2/171.3 |
| 2002/0014300 | A1 | * | 2/2002 | Itoh | 156/93 |
| 2006/0214484 | A1 | * | 9/2006 | Zaharakos | 297/218.1 |

OTHER PUBLICATIONS

Merriam Webster's online dictionary, "Seam".*
Textiles, Wikipedia.com, p. 1.*

* cited by examiner

*Primary Examiner*—Gary L. Welch
*Assistant Examiner*—Robert H. Muromoto
(74) *Attorney, Agent, or Firm*—Christopher Wood; Wood & Eisenberg, PLLC

(57) ABSTRACT

A brand new and unexpected textured fabric or textile that can be used to provide articles of clothing (for humans and/or animals), wall hangings, home decorating articles, headwear, footwear, etc. The method transforms one dimensional fabric or textile into three dimensional fabric or textile tubes having height, breadth, width, length and depth, which can in turn be weaved into an unlimited array of garments, articles of clothing, fabrics for hanging up on walls, etc.

3 Claims, 4 Drawing Sheets

WEAVED ARTICLE OR GARMENT AND METHOD OF MAKING WEAVED ARTICLE OR GARMENT

CROSS-REFERENCE TO RELATED APPLICATIONS

This application claims the benefit of priority from U.S. Provisional Patent Application Ser. No. 60/616,124, filed Oct. 6, 2004, the entire contents of which are incorporated herein by reference.

FIELD OF THE INVENTION

The present invention relates generally to weaved articles and garments. More specifically, the invention is methods of making a weaved article or garment, and a weaved article or garment that is made by the methods of the present invention.

BACKGROUND OF THE INVENTION

The basic function of the clothing industry is to provide suitable exterior attire for humans and animals. Another function of the clothing industry, particularly with regard to the contemporary age, is to provide fashionable clothing, which makes a person feel good and/or look good. There is a need for new clothing styles and fashions to satisfy real or latent demand for such items. In addition, there is a need for new garments, fabrics and new methods of making garments and fabrics.

SUMMARY OF THE INVENTION

The present invention is methods of making a weaved article or garment suitable for wearing by humans or animals, and a weaved article or garment that is made by the methods of the present invention.

A first method of making a weaved article or garment includes the steps of:

1) providing a plurality of sections of natural or synthetic fabric or textiles;

2) folding each section to provide a plurality of folded sections;

3) seaming each folded section to provide a plurality of seamed tubes;

4) turning each seamed tube inside out; and 5) weaving the inside out seamed tubes to provide a weaved article or garment.

A second method of making a weaved article or garment includes the steps of:

1) providing a plurality of sections of natural or synthetic fabric or textiles;

2) folding each section to provide a plurality of folded sections;

3) seaming each folded section to provide a plurality of seamed tubes; and 4) weaving the seamed tubes to provide a weaved article or garment.

A first embodiment of a weaved article or garment of the present invention is a weaved article or garment that is made by the first method described above.

A second embodiment of a weaved article or garment of the present invention is a weaved article or garment that is made by the second method described above.

It should be understood that the attached figures do not limit the scope of the present invention in any way.

DETAILED DESCRIPTION OF THE PRESENT INVENTION

The present invention is methods of making a weaved article or garment, and a weaved article or garment that is made by the methods of the present invention.

Figure 1:
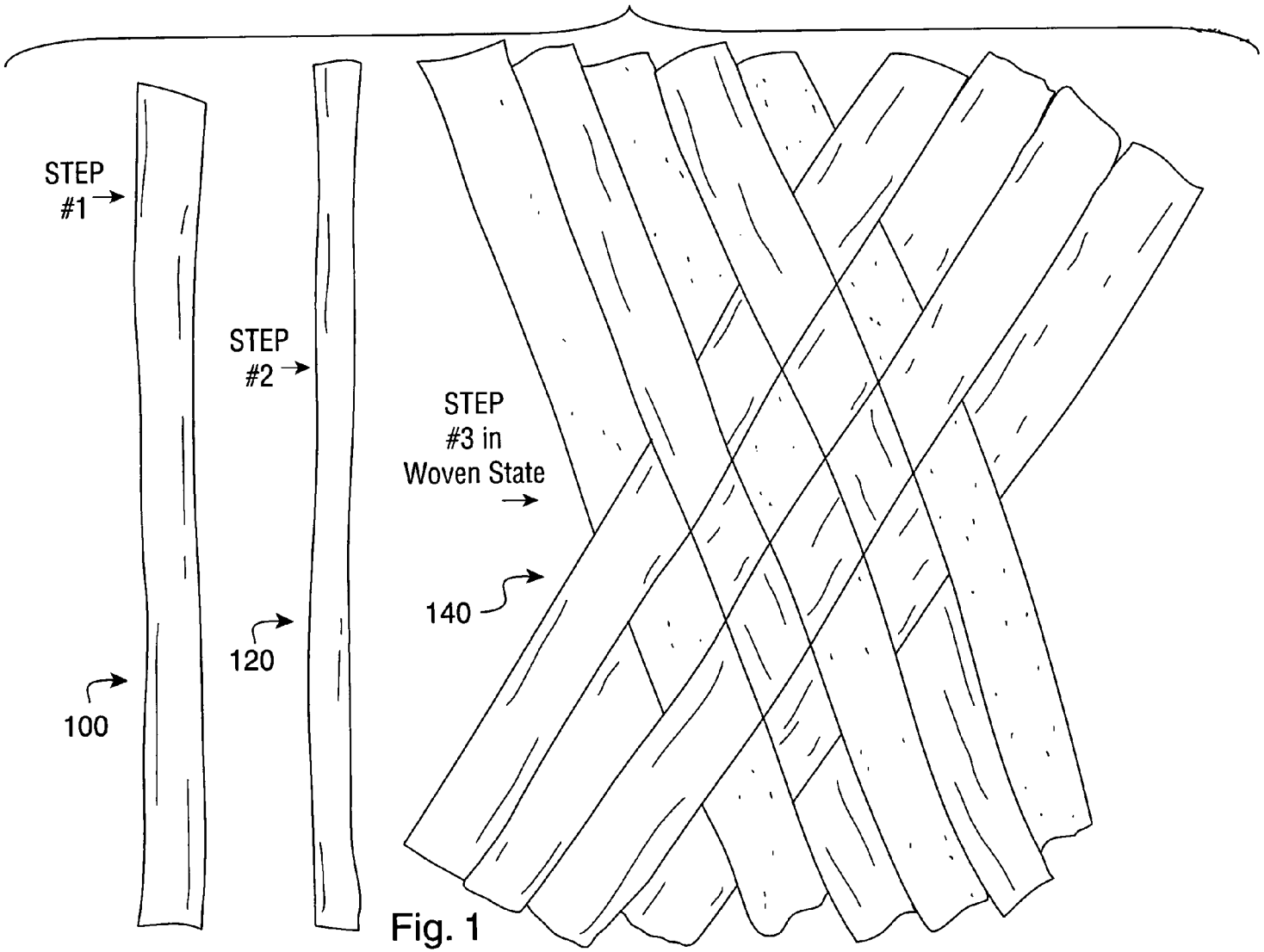
FIGS. 1 and 2 show methods of making a weaved article or garment according to the present invention.
Figure 2:
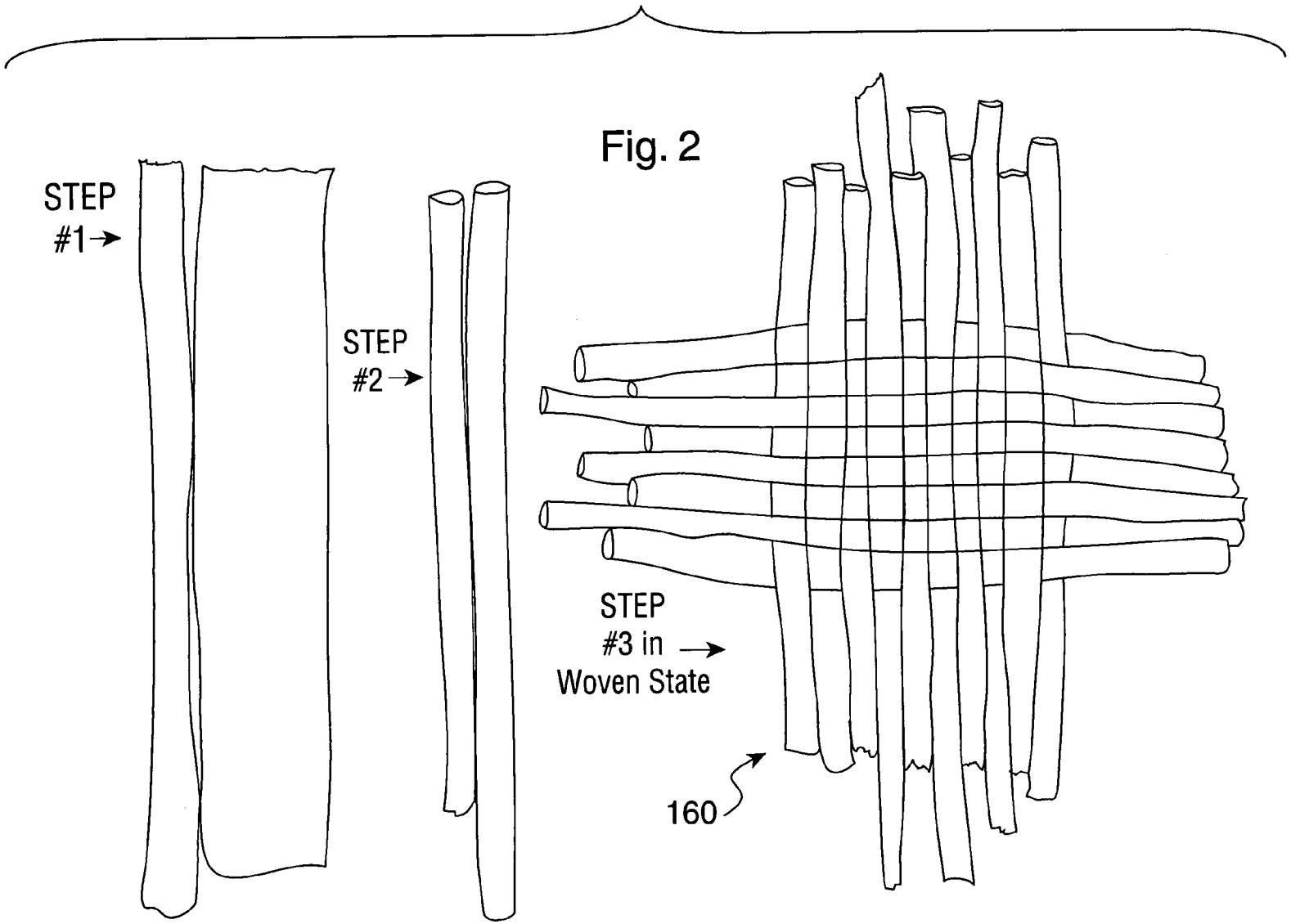
Figure 3:
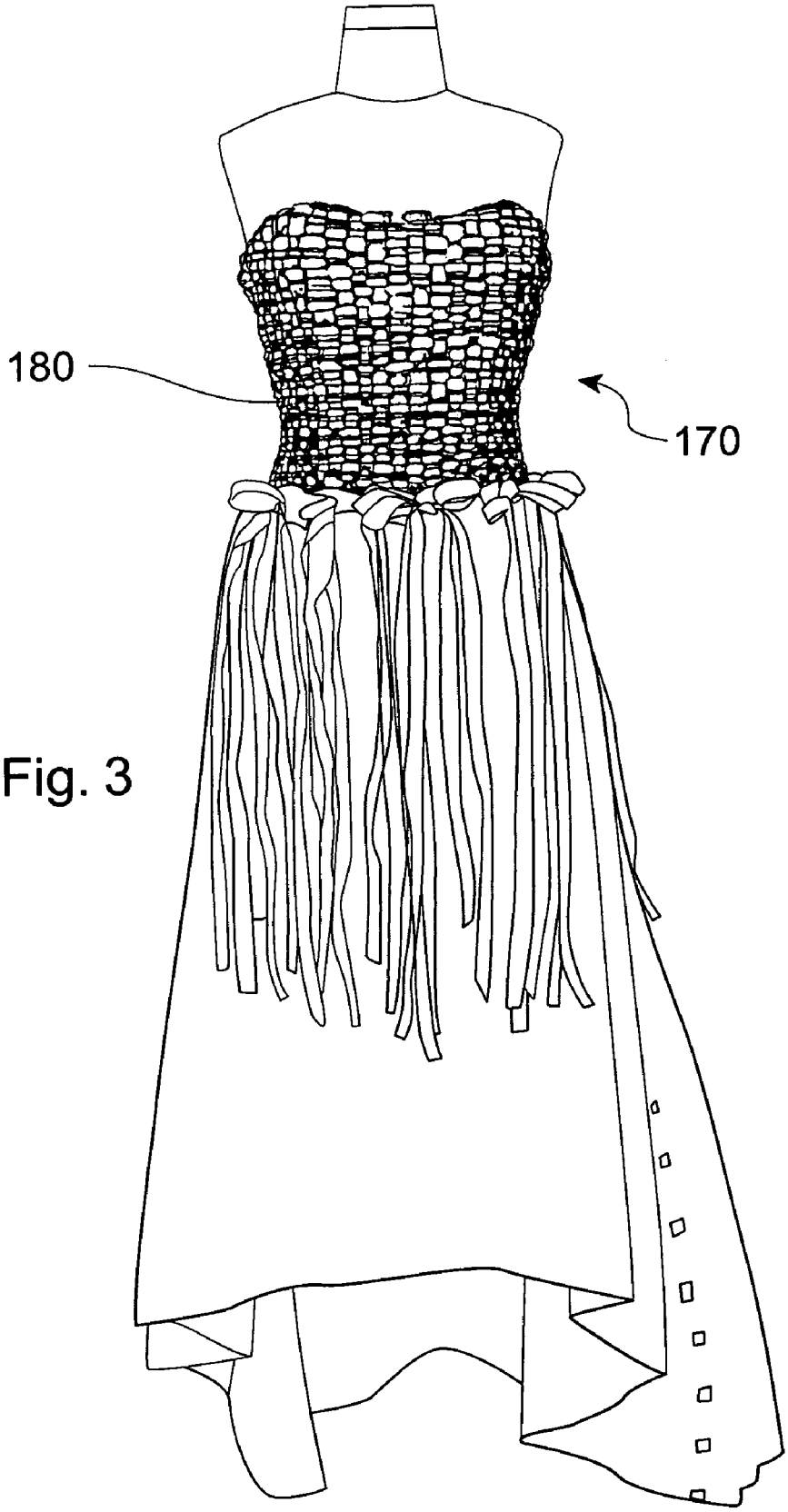
FIG. 3 shows a front view of a weaved garment that includes a plurality of waved seamed tubes according to the present invention.
Figure 4:
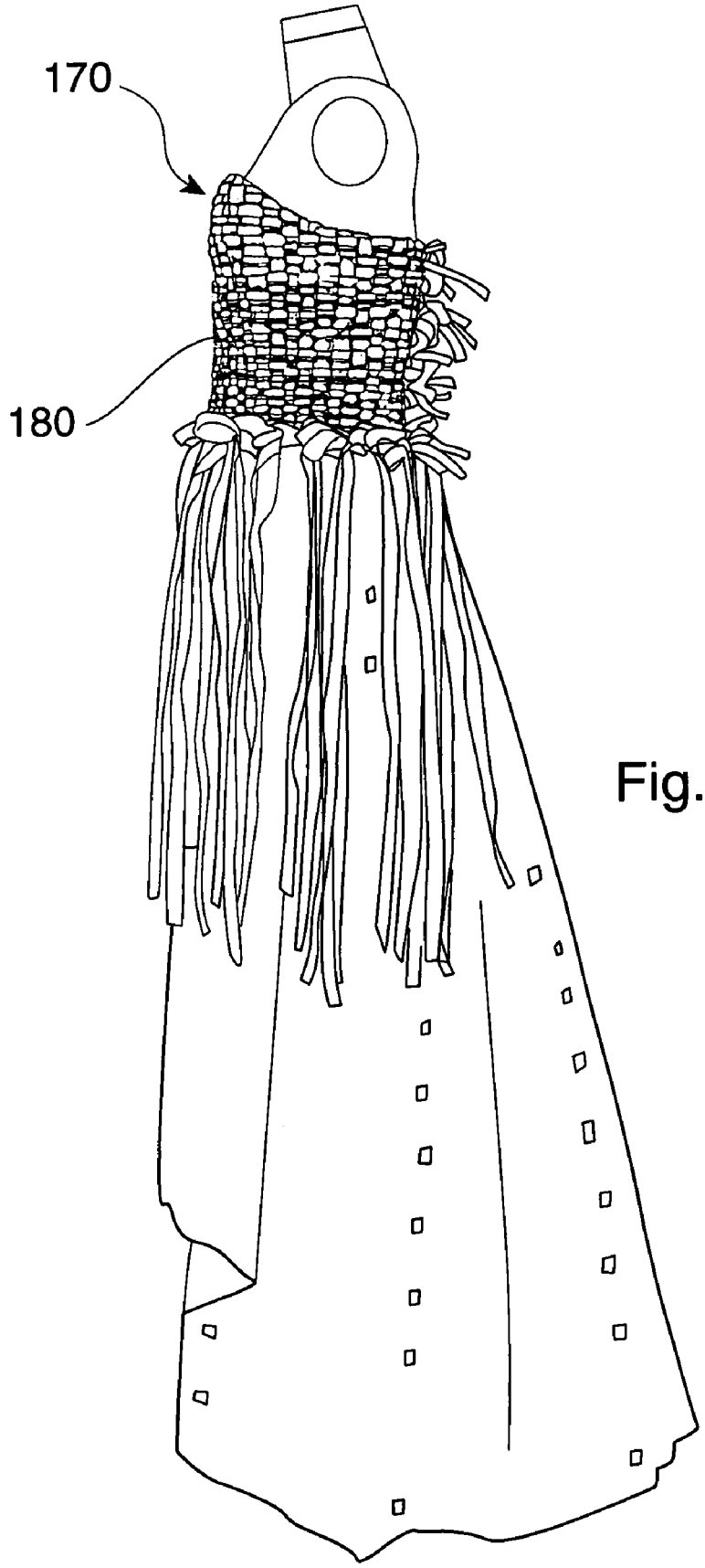
FIG. 4 shows a side view of the garment of FIG. 3.

Examples of methods of making a weaved article or garment according to the present invention is shown in FIGS. 1 and 2. An example of a weaved article or garment that is made by a method of the present invention is shown in FIGS. 3 and 4. It should be understood that the present invention is not limited to the weaved article or garment and methods of making a weaved article or garment shown in FIGS. 1 through 4. Humans or animals can wear the articles, garments and/or fabrics of the present invention.

Referring to the FIGURES in general and FIG. 1 in particular, a section of fabric 100 is folded to provide a folded section 120, which is then seamed, and optionally turned inside out, to provide a seamed tube. A plurality of inside out seamed tubes is weaved to provide a weaved article or cloth 140. Different patterns of weaved articles can be made such as a square weaved pattern 160 which comprises a plurality of inside out seamed tubes (see FIG. 2).

FIG. 3 shows a weaved garment 170 that includes a plurality of waved seamed tubes 180, and FIG. 4 shows a side view of the garment 170.

A first method of making a weaved article or garment includes the steps of:

1) providing a plurality of sections of natural or synthetic fabric or textiles, including but not limited to cloth, fur, faux fur, plastic, and wool;

2) folding each section to provide a plurality of folded sections;

3) seaming each folded section to provide a plurality of seamed tubes;

4) turning each seamed tube inside out; and 5) weaving the inside out seamed tubes to provide a weaved article or garment, including but not limited to inches or yards of fabric woven into a variety of styles, including but not limited to the "basket weave," "diamond weave," and "triangle weave."

A second method of making a weaved article or garment includes the steps of:

1) providing a plurality of sections of natural or synthetic fabric or textiles, including but not limited to cloth, fur, faux fur, plastic, and wool;

2) folding each section to provide a plurality of folded sections;

3) seaming each folded section to provide a plurality of seamed tubes; and 4) weaving the seamed tubes to provide a weaved article or garment, including but not limited to inches or yards of fabric woven into a variety of style, including but not limited to the "basket weave," "diamond weave," and "triangle weave."

A first embodiment of a weaved article or garment of the present invention is a weaved article or garment that is made by the first method described above.

A second embodiment of a weaved article or garment of the present invention is a weaved article or garment that is made by the second method described above.

In another embodiment of the present invention, a process of transforming one dimensional fabric or textiles into multidimensional tubes having height, breadth, depth and width is achieved by the process of:

1. starting with any existing natural or synthetic fabric or textiles, including but not limited to cloth, fur, faux fur, plastic (e.g., nylon), wool, cut or rip into vertical, horizontal or circular strips of any suitable length and/or width;
2. On the wrong (or right) side of the fabric or textile, seam lengthwise along edges seam ends as much as possible to create one or more tubes; and
3. using a fabric turner or other instrument, turn the seamed fabric tubes onto the right or opposite sides to provide one or more fabric tubes, which can be weaved into a variety of styles, including but not limited to, inches or yards of fabric woven into, for example, "basket weave", "diamond weave", "triangle weave", etc.

The Applicant believes that she has created a brand new and unexpected textured fabric or textile that can be used to provide articles of clothing (for humans and/or animals), wall hangings, home decorating articles, headwear, footwear, etc. The present invention transforms one dimensional fabric or textile into three dimensional fabric or textile tubes having height, breadth, width, length and depth, which can in turn be weaved into an unlimited array of garments, articles of clothing, fabrics for hanging up on walls, etc.

The term "article" is intended to cover any kind of article that comprises a plurality of weaved tubes of the present invention. Non-limiting examples of such articles include: headwear, footwear, wall hangings, home decorations, a piece of cloth, and garments comprising a plurality of weaved tubes of the present invention.

A piece of cloth made by the method of the present invention can be used, for example, in making a dress, wherein the dress comprises different pieces of cloth, some of which may be prior art pieces of cloth. Thus, it should be understood, that the invention is intended to cover any article that is part made with a piece of cloth made by the method of the present invention.

The term "garment" is intended to cover clothing for human or animal use (e.g., a dog coat that wraps around the main part of a dog's body) that comprises a plurality of tubes according to the present invention. Thus, the term "article" is far broader than the term "garment".

The unique feature of this invention is that it transforms any regular one dimensional fabric or textile into a three dimensional fabric or textile tube having height, breadth, width, length and depth; the invention creates an unexpected three dimensional look to the weaved article. After many fabric tubes are created, they are then woven together to create a completely new textured fabric or textile which gives articles, including but not limited to clothing, rugs, wall hangings, home decorating articles, footwear, and headwear, a distinctive look and feel.

In one aspect of the present invention a method of making a weaved article or garment, the method comprises the steps of: providing a plurality of generally elongated sections of natural or synthetic fabric or textiles; folding each section to provide a plurality of folded sections; seaming each folded section to provide a plurality of seamed tubes; and weaving the seamed tubes to provide said weaved article. This method can be used, for example, to produce a piece of cloth and/or a garment.

It is to be understood that the present invention is not limited to the embodiments described above, but encompasses any and all embodiments within the scope of the following claims.

The invention claimed is:

1. A method of making a weaved article or garment, the method comprising the steps of:

providing a plurality of sections of natural or synthetic fabric or textiles;

folding each section to provide a plurality of folded sections;

seaming each folded section to provide a plurality of seamed tubes;

turning each seamed tube inside out; and weaving the inside out seamed tubes to provide a weaved article or garment.

2. A piece of cloth produced by the method of claim 1.

3. A garment produced by the method of claim 1.

* * * * *